US009409079B2

(12) United States Patent
Park

(10) Patent No.: US 9,409,079 B2
(45) Date of Patent: Aug. 9, 2016

(54) DRY-LAND ALPINE SKIS

(71) Applicant: David Park, Long Beach, CA (US)

(72) Inventor: David Park, Long Beach, CA (US)

( * ) Notice: Subject to any disclaimer, the term of this patent is extended or adjusted under 35 U.S.C. 154(b) by 2 days.

(21) Appl. No.: 14/602,149

(22) Filed: Jan. 21, 2015

(65) Prior Publication Data

US 2015/0202522 A1 Jul. 23, 2015

Related U.S. Application Data

(60) Provisional application No. 61/930,028, filed on Jan. 22, 2014.

(51) Int. Cl.

| | |
|---|---|
| ***A63C 5/12*** | (2006.01) |
| ***A63C 5/048*** | (2006.01) |
| ***A63C 17/00*** | (2006.01) |
| ***A63C 17/04*** | (2006.01) |

(52) U.S. Cl.

CPC ..... *A63C 5/048* (2013.01); *A63C 17/0066* (2013.01); *A63C 17/045* (2013.01); *A63C 5/12* (2013.01); *Y10T 29/4984* (2015.01); *Y10T 29/49817* (2015.01)

(58) Field of Classification Search

None

See application file for complete search history.

(56) References Cited

U.S. PATENT DOCUMENTS

| | | | | | |
|---|---|---|---|---|---|
| 3,696,877 | A | * | 10/1972 | Dessureault | B62M 27/02 180/184 |
| 4,208,073 | A | * | 6/1980 | Hechinger | A63C 17/223 152/323 |
| 4,763,909 | A | * | 8/1988 | Bergeron | A63C 17/04 280/11.25 |
| 4,768,793 | A | | 9/1988 | Spencer | |
| 4,805,936 | A | | 2/1989 | Krantz | |
| 4,886,298 | A | | 12/1989 | Shols | |
| 4,892,332 | A | | 1/1990 | Jennings | |
| 4,898,403 | A | | 2/1990 | Johnson | |
| 4,955,626 | A | * | 9/1990 | Smith | A63C 5/16 280/11.28 |
| 5,195,781 | A | * | 3/1993 | Osawa | A63C 5/035 280/11.28 |
| 5,401,037 | A | * | 3/1995 | O'Donnell | A63C 17/22 280/11.204 |
| 5,553,874 | A | * | 9/1996 | Schouten | A63C 17/004 280/11.28 |
| 5,833,252 | A | | 11/1998 | Strand | |

(Continued)

OTHER PUBLICATIONS

Rick Simmons, "Homemade Roller Ski", www.xcskiworld.com, Internet Archive—https://web.archive.org/web/20050228230317/http://www.xcskiworld.com/, Mar. 5, 2005, 8 pages.

(Continued)

*Primary Examiner* — John Walters
*Assistant Examiner* — Hilary L Johns
(74) *Attorney, Agent, or Firm* — Madeline F. Schiesser; Keohane & D'Alessandro PLLC

(57) ABSTRACT

A wheeled device, and method of making thereof, that simulates the feel and performance of alpine skiing/snowboarding on dry land is provided. Features of embodiments include: (1) a deck having flex similar to that of a ski/snowboard; (2) placement of wheels in a geometry mimicking the side cut of a shaped alpine ski/snowboard, and that with feature (1), enables a user to turn the device in an arc; and (3) wheels constructed of materials of varied coefficients of friction, which enable a user to skid the device in a braking mechanism similar to that of an alpine ski/snowboard, with the placement and design of the wheels emulating the base edge bevel of a typical snow-ski/snowboard. In an embodiment, the device is affixed to a user's feet using a binding device similar to that used for alpine skiing/snowboarding, and the user primarily relies on gravity on an inclined plane for locomotion.

21 Claims, 13 Drawing Sheets

(56) References Cited

U.S. PATENT DOCUMENTS

| | | | | |
|---|---|---|---|---|
| 5,855,385 | A * | 1/1999 | Hambsch | A63C 17/004 280/842 |
| 5,868,408 | A * | 2/1999 | Miller | A63C 17/0046 280/11.28 |
| 5,901,981 | A | 5/1999 | Lucht | |
| 5,975,546 | A | 11/1999 | Strand | |
| 5,992,865 | A * | 11/1999 | Vargas | A63C 17/01 280/87.041 |
| 6,237,960 | B1 | 5/2001 | Dornhofer | |
| 6,286,843 | B1 * | 9/2001 | Lin | A63C 17/0066 280/11.28 |
| 6,669,215 | B2 | 12/2003 | Laporte | |
| 6,848,750 | B2 * | 2/2005 | Hurwitz | A63C 17/0066 152/40 |
| 6,988,742 | B2 | 1/2006 | Jonsson et al. | |
| D530,765 | S | 10/2006 | Rojas | |
| 7,213,823 | B1 | 5/2007 | Vujtech | |
| 7,784,833 | B2 | 8/2010 | Tsuchie | |
| 8,360,475 | B2 * | 1/2013 | Cristiano | A63C 17/004 280/11.19 |
| 2004/0113379 | A1 | 6/2004 | Harb et al. | |
| 2004/0239065 | A1 * | 12/2004 | Smith | A63C 17/0026 280/87.042 |
| 2013/0026728 | A1 * | 1/2013 | Genov | A63C 17/012 280/87.042 |

OTHER PUBLICATIONS

"Freebord Complete Boards", www.freebordstore.com, http://www.freebordstor.com/complete-boards-amp-packages.html. May 9, 2012, 2 pages.

CTXCARVE, "Inline Skates for Alpine Skiers", www.streetski.com, Copyright 2009, 3 pages.

Harb Carver: Quick-Start Guide, Copyright 2003 Harb Ski Systems, Inc., 7 pages.

Rick Simmons, "Homemade Roller Ski", www.xcskiworld.com, 7 pages.

Adam Pinney, Snowsport England, "Roller Skiing Equipment", www.snowsportengland.org.uk, Nov. 2011, 7 pages.

Mike Muha, "Ski Skett Shark", www.nordicskiracer.com, Aug. 14, 2004, 4 pages.

"Freebord Complete Boards", www.freebordstore.com, 2 pages.

* cited by examiner

DRY-LAND ALPINE SKIS

CROSS-REFERENCE TO RELATED APPLICATIONS

The present patent document claims priority to U.S. provisional patent application Ser. No. 61/930,028, filed Jan. 22, 2014 and entitled "DRY-LAND ALPINE SKIS", the contents of which are incorporated herein by reference.

FIELD OF THE INVENTION

This invention relates generally to modified alpine skis and snowboards for use on dry-land surfaces, and more specifically to modified alpine skis and snowboards having a plurality of angled wheels.

BACKGROUND

Alpine skiing (also known as downhill skiing) and snowboarding are popular sports and hobbies shared by millions of people throughout the world. Typically, however, these sports require access to expensive sporting hardware and winter clothing and travel to select regions, as alpine skiing and snowboarding require cold climates and high elevations to create the requisite snow surface on an inclined trail (for example, on hills and/or mountains) necessary for downhill skiing or snowboarding.

Alpine skiing is typically characterized by skis with fixed-heel bindings. Generally, alpine skis are not used for walking or hiking, unlike cross-country skis which are typically characterized by free-heel bindings. However, some alpine skiers employ poles for assistance with short distance locomotion, walking, skating, steering, balance, etc. Typically, alpine skiers rely on mechanical assistance to reach the top of a hill. At ski resorts, services such as ski lifts are provided, while back-country skiers rely on helicopters or snowcats, if not hiking, to transport them to a ski site. These forms of assistance in snowy regions can be cost-prohibitive, subject to narrow time windows, and time-consuming, particularly during a region's "busy season".

Snowboarding is typically characterized by a board which glides downhill on snow and on which the snowboarder stands with feet substantially transverse to the longitude of the board. Commercial snowboards generally require equipment such as bindings and special boots which secure both feet of a snowboarder to the board. As with alpine skis, snowboards are generally not used for walking or hiking, and snowboarders generally rely on mechanical assistance to reach the top of a hill.

SUMMARY OF THE INVENTION

Embodiments described herein provide a wheeled device, and method of making thereof, that simulates the feel and performance of alpine skiing/snowboarding on dry land. Features of embodiments include: (1) a deck having flex similar to that of a ski/snowboard; (2) placement of wheels in a geometry mimicking the side cut of a shaped alpine ski/snowboard, and that with feature (1), enables a user to turn the device in an arc; and (3) wheels constructed of materials of varied coefficients of friction, which enable a user to skid the device in a braking mechanism similar to that of an alpine ski/snowboard, with the placement and design of the wheels emulating the base edge bevel of a typical alpine snow-ski/snowboard. In an embodiment, the device is affixed to a user's feet using a binding device similar to that used for alpine skiing/snowboarding, and the user primarily relies on gravity on an inclined plane for locomotion.

A first aspect of the present invention includes a wheeled ski device, the device comprising: a base board, the base board including an elongated structure having a top surface and a bottom surface and having a transitional point on a longitudinal axis of the elongated structure; and a plurality of opposing pairs of wheels coupled to opposite edges of the elongated structure at various points along the longitudinal axis of the elongated structure, wherein an axis of each wheel is set at a first angle relative to an x-y plane that is positive relative to the top surface, the plane formed by the longitudinal axis of the base board and a lateral axis of the base board; and wherein the axis of each wheel is further set at a second angle relative to an y-z plane of the base board that is open towards the transitional point, the plane comprising the longitudinal axis and perpendicular to the y-z plane.

Another aspect of the present invention includes a method of making a wheeled ski device, the method comprising: affixing a plurality of opposing pairs of angled axels to opposite sides of a longitudinal axis of an elongated structure of a base board at various points along the longitudinal axis of the elongated structure, the base board having a transitional point on the longitudinal axis of the elongated structure; and affixing a wheel to each axel, wherein each axel is set at a first angle relative to an x-y plane that is positive relative to a top surface of the base board, the plane formed by the longitudinal axis of the base board and a lateral axis of the base board; and wherein the axel is further set at a second angle relative to an y-z plane of the base board that is open towards the transitional point, the plane comprising the longitudinal axis and perpendicular to the y-z plane.

Yet another aspect of the invention includes a method of using a wheeled ski device, the method comprising: moving a wheeled ski device having a base board including an elongated structure and having a transitional point on a longitudinal axis of the elongated structure, and a plurality of opposing pairs of wheels coupled to opposite edges of the elongated structure at various points along the longitudinal axis of the elongated structure, wherein an axel of each wheel is oriented at a positive angle above a horizontal plane relative to a top surface of the base board and at an angle facing towards the transitional point relative to a vertical plane comprising the longitudinal axis and perpendicular to the horizontal axis that decreases with distance from the transitional point; engaging a side of the wheeled ski device by turning the wheeled ski device on a side; causing the wheeled ski device to turn in an arc in response to engaging the side; disengaging the side of the wheeled ski device by reorienting the wheeled ski device; and causing the wheeled ski device to skid in response to disengaging the side.

BRIEF DESCRIPTION OF THE DRAWINGS

These and other features of this invention will be more readily understood from the following detailed description of the various aspects of the invention taken in conjunction with the accompanying drawings in which.

Figure 1:
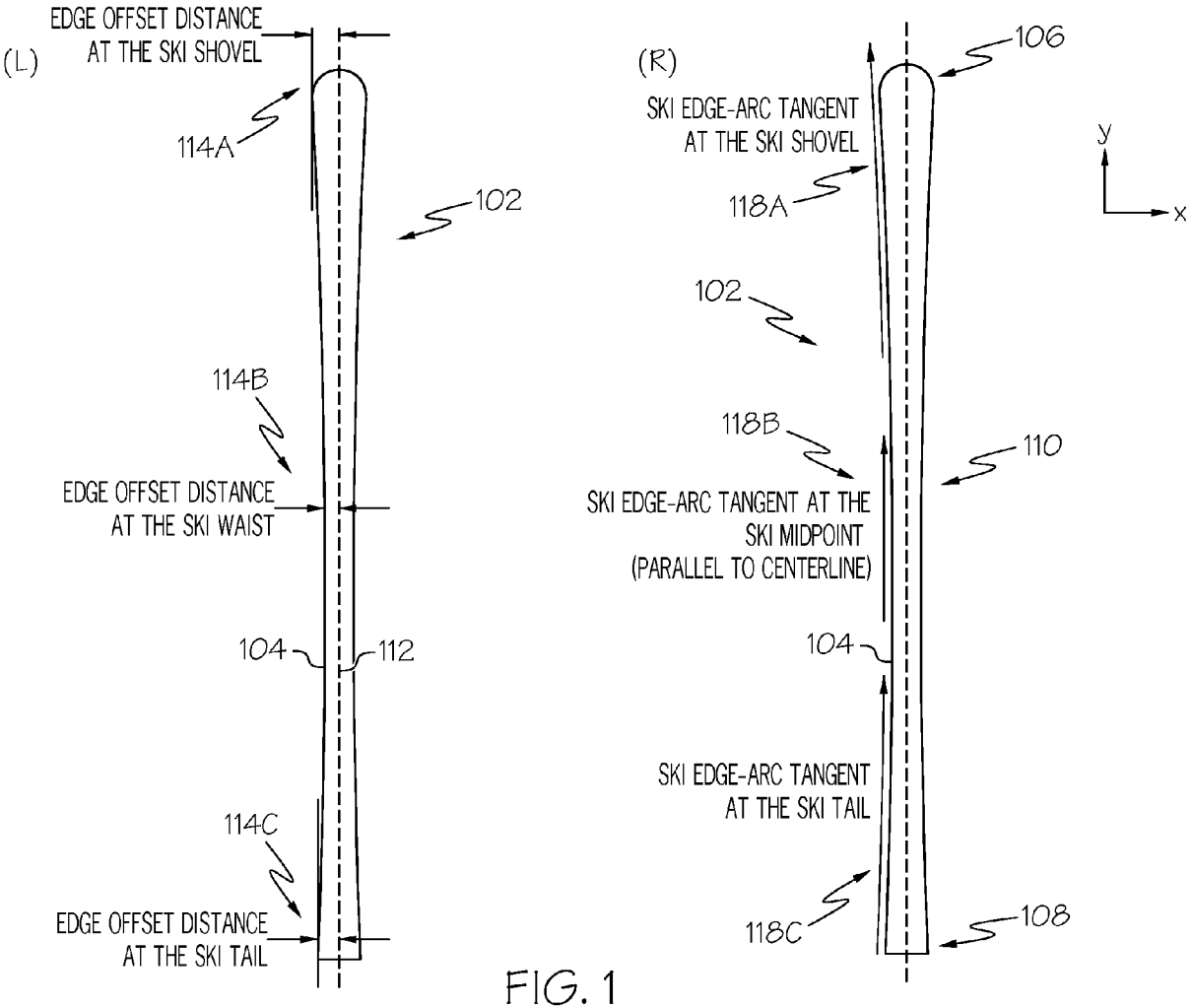
FIG. 1 depicts a set of alpine snow skis according to an embodiment of the present invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION

Illustrative embodiments will now be described more fully herein with reference to the accompanying drawings, in which exemplary embodiments are shown. It will be appreciated that this disclosure may be embodied in many different forms and should not be construed as limited to the embodiments set forth herein. Rather, these illustrative embodiments are provided so that this disclosure will be thorough and complete and will fully convey the scope of this disclosure to those skilled in the art. In the description, details of well-known features and techniques may be omitted to avoid unnecessarily obscuring the presented embodiments.

Furthermore, the terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. The term "set" is intended to mean a quantity of at least one. It will be further understood that the terms "comprises" and/or "comprising", or "includes" and/or "including", when used in this specification, specify the presence of stated features, regions, integers, steps, operations, elements, and/or components, but do not preclude the presence or addition of one or more other features, regions, integers, steps, operations, elements, components, and/or groups thereof.

Embodiments of this invention are directed toward providing a dry-land alpine skiing device that simulates the turning curvature and sliding components of an inclined snow surface alpine skiing experience, but on a dry-land inclined surface. Accordingly, as indicated above, a wheeled device, and method of making thereof, that simulates the feel and performance of alpine skiing/snowboarding on dry land is provided herein. Features of embodiments include: (1) a deck having flex similar to that of a ski/snowboard; (2) placement of wheels in a geometry mimicking the side cut of a shaped alpine ski/snowboard, and that with feature (1), enables a user to turn the device in an arc; and (3) wheels constructed of materials of varied coefficients of friction, which enable a user to skid the device in a braking mechanism similar to that of an alpine ski/snowboard, with the placement and design of the wheels emulating the base edge bevel of a typical alpine snow-ski/snowboard. In an embodiment, the device is affixed to a user's feet using a binding device similar to that used for alpine skiing/snowboarding, and the user primarily relies on gravity on an inclined plane for locomotion.

Embodiments of the invention modify alpine skis and snowboards to enable a user's recreational or sporting experience on a dry inclined surface to emulate those of typical alpine skiing. As used herein for the purpose of describing particular embodiments, the terms "alpine skiing", "skiing", "downhill skiing", "monoskiing", "alpine touring skiing", "downhill snowboarding", "snowboarding", "boarding" and the like, may be used interchangeably to refer to the act of alpine skiing and/or snowboarding, and are not intended to be limiting. Furthermore, as used herein for the purpose of describing particular embodiments, the terms "alpine ski", "ski", "downhill ski", "carving ski", "snow ski", "monoski", "alpine touring ski", "downhill snowboard", "snowboard", "board" and the like, may be used interchangeably to refer to an alpine ski and/or snowboard, and are not intended to be limiting.

Referring now to FIG. 1, a set of alpine snow skis according to an embodiment of the present invention is depicted. In a typical embodiment, each individual ski 102 comprises a flat board that is a composite construct of one or more of wood, fiberglass, plastic, and metal and bound by a bonding agent such as epoxy resin. The ski has a top, a bottom, a front 106, a rear 108, and a midpoint 110. The width "x" and thickness "z" of the skis 102 is variable based on the performance needs of the ski and the manufacturer's construction. The length "y" of ski 102 provides stability. A user selects a ski length that is consistent with the user's ability level and style of skiing. A longer ski provides more stability, but is also more difficult to control. Ski 102 also has "flex," the ability to bend. Flex allows ski 102 to bend along the y-z plane in order to engage an edge of ski 102 with the ground. Each ski 102 is mechanically attached to the user, typically via a ski binding and a ski boot (not shown). Skis of a pair are identical to one another.

Front tip 106 of ski 102, called the "shovel", is typically pointed or rounded and turned up so the device will stay on top of a snowy surface. Ski rear 108, called the "tail", is typically flat and square. Shovel 106 and tail 108 are in most cases wider than the ski midpoint 110, called the "waist". An imaginary line that bisects the longitudinal plane of ski 102 may be described as ski centerline 112. The distance from ski centerline 112 to a side edge 104 of ski 102 is called the "edge offset distance" 114. As the ski width is variable, the edge offset distance is also variable along the body of ski 102. For example, edge offset distance 114A and 114C at shovel 106 and tail 108, respectively, of ski 102 are wider than edge offset distance 1148 at waist 110 of ski 102. Ski 102 is symmetric across centerline 112, therefore each edge 104 is a mirror image of its opposite.

Figure 2:
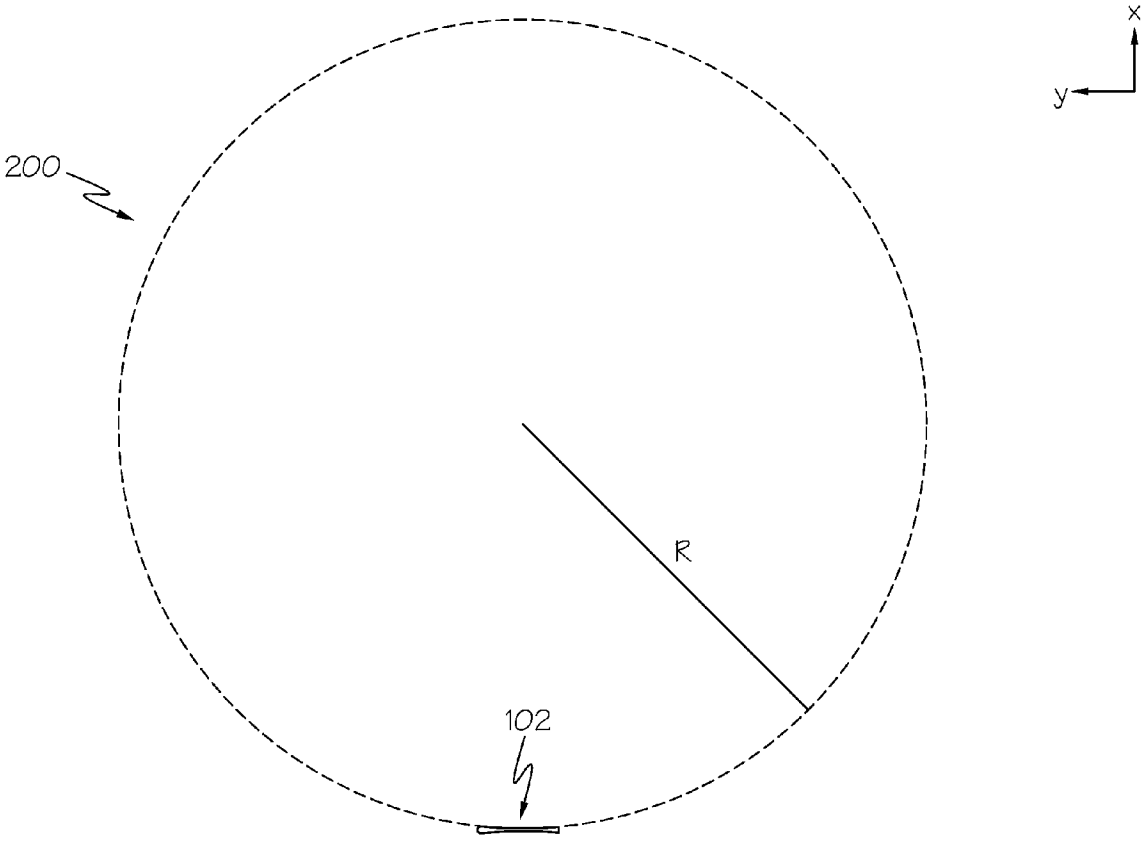
FIG. 2 depicts the geometry of an alpine ski edge-arc according to an embodiment of the present invention.

The shape of ski edge 104 is referred to as the ski "side cut". The side cut is typically a curve, based on a circle of radius "R", which typically ranges from 8 meters to 55 meters, depending on the performance characteristics the skier chooses. Referring now to FIG. 2, the x-y plane view of an alpine ski (pictured from the bottom), superimposed against the circumference of a circle of radius "R", that specifies the geometry of the ski edge-arc, is depicted. As seen in FIG. 2, when fully engaged with the ground, the minimum circle ski 102 can turn upon is circle 200 of radius "R". Referring back to FIG. 1, tangents 118A-C to circle 200 are shown along ski edge 104 to further illustrate the congruence of curve of ski edge 104 with the curve of circle 200.

Figure 3:
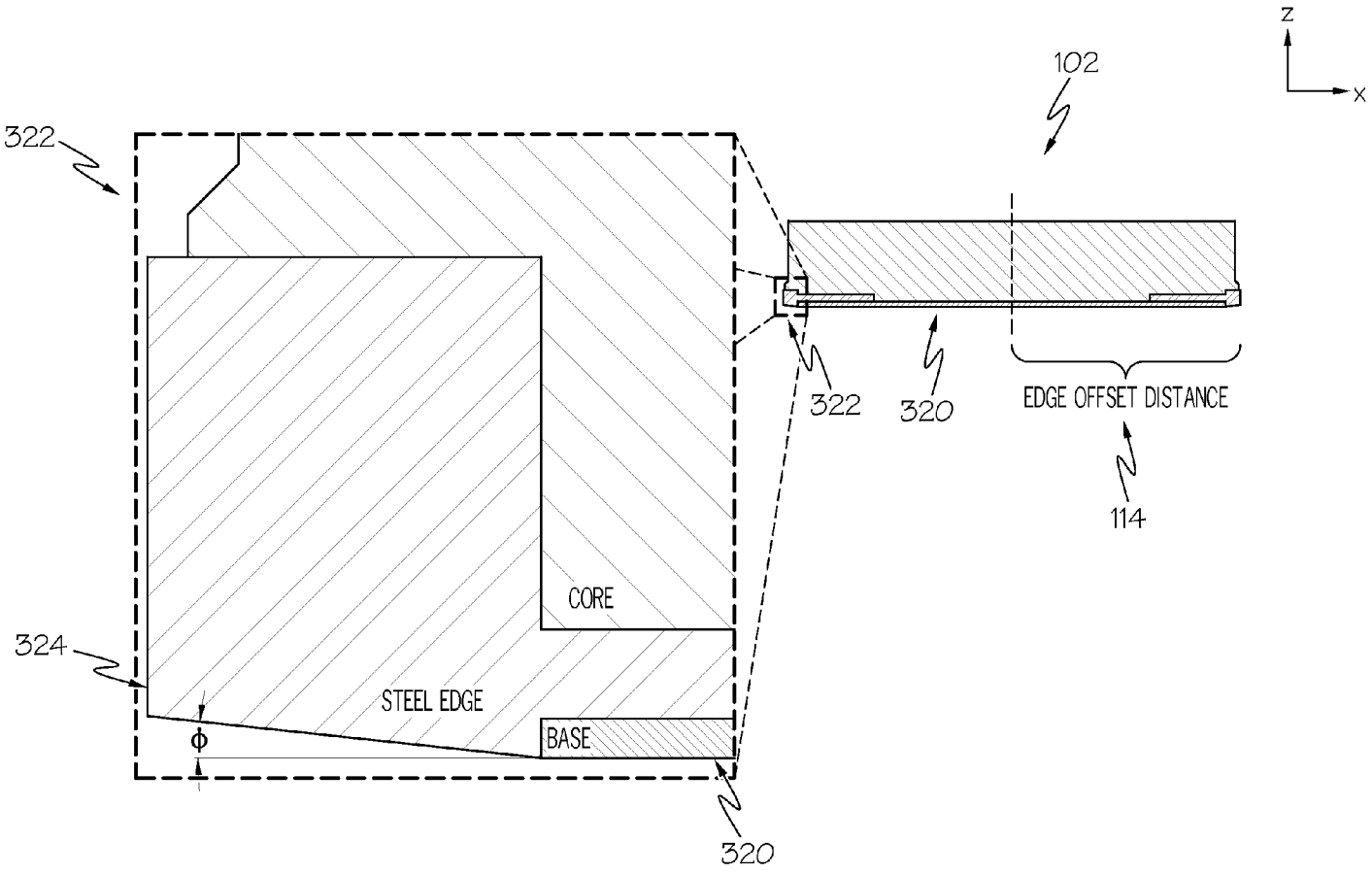
FIG. 3 depicts a cross-section of an alpine snow ski with expanded view of a base bevel according to an embodiment of the present invention.

Referring now to FIG. 3, a cross-section of an alpine snow ski in the x-z plane is depicted. FIG. 3 further shows a magnification of the edge section of an alpine snow ski in order to demonstrate how "base bevel" is built into the edge of an alpine ski. Generally, base 320 of ski 102 (i.e., the portion of ski 102 in contact with the ground) is flat, with the exception of base edges 322. Typically, the entire length of base edges 322 are lined with steel that is ground or sharpened to a relatively sharp chisel blade edge 324. Steel blade edge 324 is cut such that when viewing the ski cross-section, steel blade edge 324 lies at an upward, acute angle, "Φ", relative to the horizontal (x-y) plane; this angle is referred to as the edge angle or base bevel. Typically, recreational skies are set at 1° of base bevel (Φ=1° from horizontal), whereas racing skis are typically set at 0.5° to 0.75° of base bevel (Φ=0.5° to 0.75° from horizontal). As base bevel decreases, ski 102 becomes more responsive. To an inexperienced skier, a smaller degree of base bevel can result in a ski that is more "grabby" and more difficult to control. At 0° of base bevel, the edge runs flush with the base of the ski and the ski has the potential to catch on the wrong edge and throw the rider.

A snowboard possesses similar mechanics and structure to the ski, with the exception that the user is transported on a single deck. The user's feet are mechanically affixed to a single board via bindings and the user stance is typically sideways to the board. The board likewise has a tip, tail, waist, and side cut similar to a ski.

The sport of alpine skiing/snowboarding includes two basic mechanisms of performance: (1) flexibility, which enables an edge of the ski/board to track in the snow; and (2) the ability to skid turns.

Figure 4:
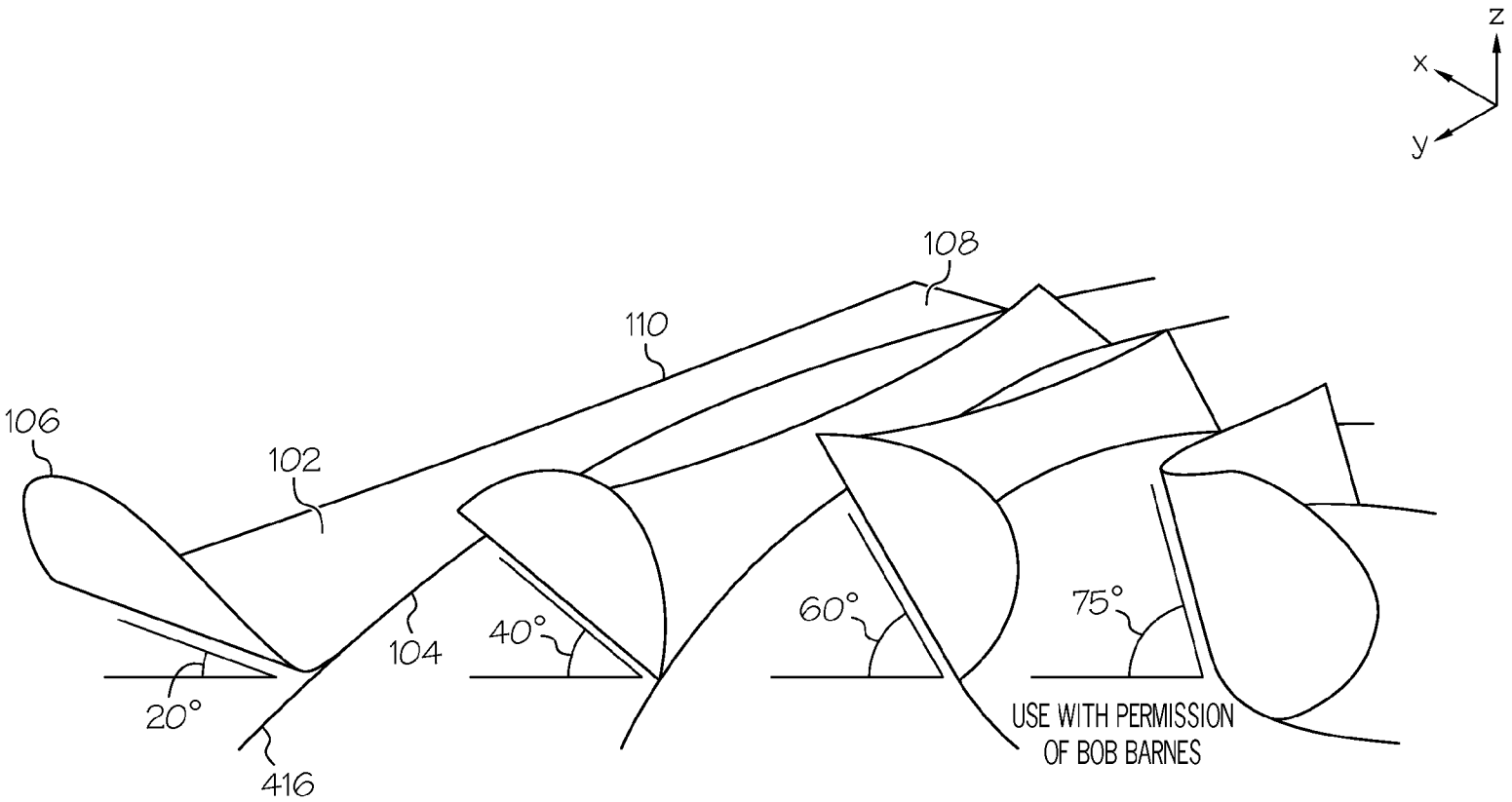
FIG. 4 depicts a carving ski in motion according to an embodiment of the present invention.

Referring now to FIG. 4, a carving ski in motion, as viewed in the x-y-z planes, is depicted. Generally, skis/boards are designed with a concave edge shape (i.e., the "side cut") which permits ski 102 to bend or flex when rolled up onto edge 104 (e.g., during a turn while skiing). As discussed above, ski 102 is wider at tip 106 and tail 108 than at waist 110. Therefore, when rolled up on edge 104, the only two points of ski 102 which would be in contact with the ground are tip 106 and tail 108. However, under a ski user's weight and centripetal force from a turn, ski 102 is forced to bend for midpoint 110 to remain in contact with the ground. In other words, as ski 102 is rolled on edge 104, the ski bends in order for edge 104 to maintain contact with the ground. Furthermore, as ski 102 is rolled on edge 104 more aggressively (e.g., from 40° to 60° above the x-y plane), the ski bends further.

The mechanism described above permits ski 102 to track in the snow along edge 104, which is in contact with the ground or, more specifically, a snowy surface. The amount of bend produced in ski 102 determines the curvature of the track of ski 102, because ski 102 tracks along the concave shape of bent ski 102 in arc 416. As discussed further below with reference to FIG. 5, if ski 102 does not slide away (i.e., skid) from the ski track, then ski 102 tracks exactly along the arc 416 of ski 102, without deviation. In this case, the user is performing a pure carve, in which ski 102 should be accelerating with no slippage of ski edge 104.

Figure 5:
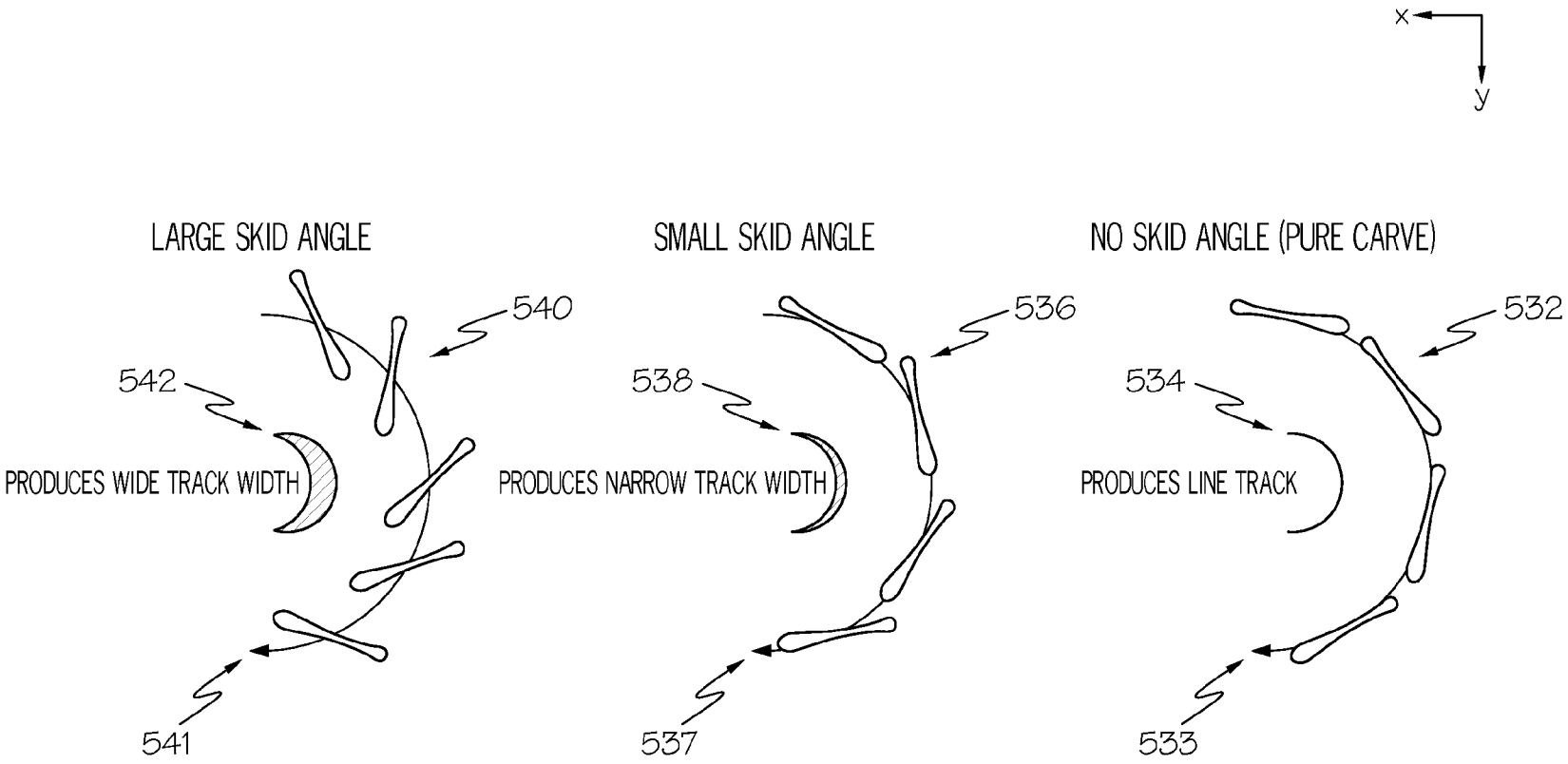
FIG. 5 depicts illustrative examples of alpine ski tracks relative to an amount of skid employed by a user according to embodiments of the present invention.

Referring now to FIG. 5 (in addition to FIG. 4), illustrative examples of alpine ski tracks relative to an amount of skid employed by a user according to embodiments of the present invention are shown. As discussed above, the second mechanism for ski performance is the ability to skid turns. Skidding allows a ski user to decelerate, for example, for speed control. Skidding occurs when the user places less pressure on ski 102, allowing the grip of edge 104 to be released from the snow/ice or other ground surface. While ski 102 is guided along ski arc 416 based on the curved shape of ski 102, a centripetal force also pulls ski 102 at a tangent to ski arc 416. Accordingly, there are two paths associated with the motion of ski 102: along ski arc 416 and along the tangent to ski arc 416. Accordingly, a ski that skids produces a wider track in the snow. Furthermore, track size is directly proportional to the degree the user skids the ski. For example, as seen in FIG. 5, time-lapse snapshot 532 of a ski in motion shows a ski with no skid angle (i.e., a pure carve) traveling in the direction of arrow 533. This time-lapse corresponds with ski track 534 which produces a thin curved line. In another example, time-lapse snapshot 536 of a ski in motion shows a ski with a small skid angle traveling in the direction of arrow 537. This small-angle time-lapse corresponds with ski track 538 which produces a narrow track width. In still another example, time-lapse snapshot 540 of a ski in motion shows a ski with a large skid angle traveling in the direction of arrow 541. This large-angle time-lapse corresponds with ski track 542 which produces a wide track width.

Figure 6:
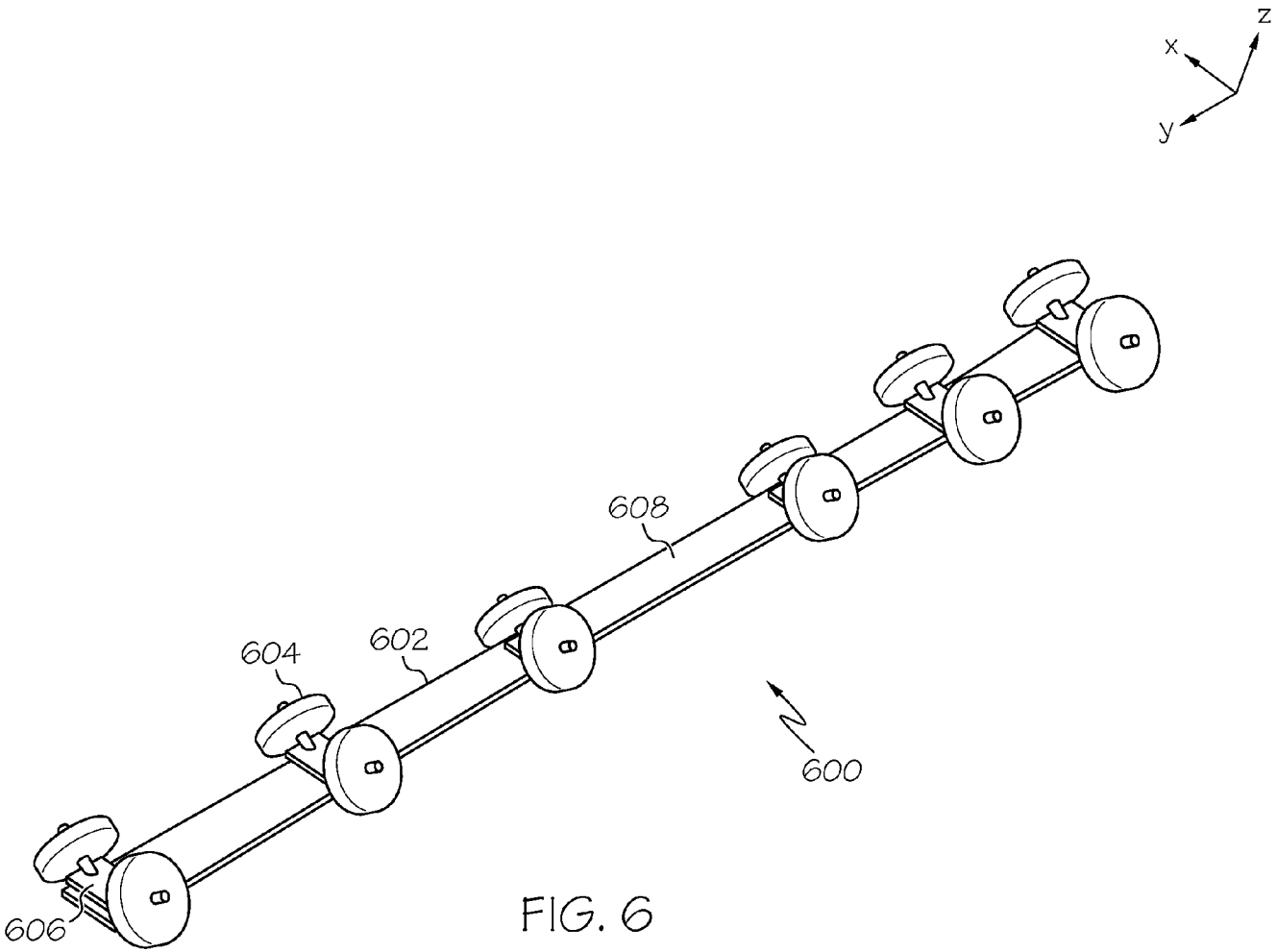
FIG. 6 depicts a dry-land ski device according to an embodiment of the present invention.

Referring now to FIG. 6, a dry-land ski device according to an embodiment of the present invention is shown. Dry-land ski device 600 may be used to "ski" down inclines on non-snow surfaces such sidewalks, asphalt, dirt tracks, grass fields, etc. In some embodiments, dry-land ski device 600 comprises ski base or "deck" 602 upon which a plurality of wheels 604 is affixed via rigid trucks 606. In some embodiments, deck 602 may be an alpine ski. In other embodiments, deck 602 may be any elongated structure similar to an alpine ski, snowboard, etc. In any case, deck 602 is configured to have the flex and length of an alpine ski. As will be discussed in more detail further below, wheels 604 are angled and arranged in pairs on opposite sides of deck 602 so as to mimic the geometry of a typical alpine ski edge. This arrangement permits dry-land ski device 600 to roll to one side on angled wheels 604, emulating a ski bending on its side. In some embodiments, trucks 606 may be attached to a top surface of deck 602. In some other embodiments, trucks 606 may be attached to a bottom surface of deck 602 or to a side surface of deck 602. The location of trucks 606 with respect to deck 602 shown in FIG. 6 is not intended to be limiting. Although not depicted in FIG. 6, embodiments of dry-land ski device 600 may comprise a binding or boot/shoe/foot attachment at site 608, as is typically employed to attach alpine skis to a user's feet.

Figures 7A, 7B, 7C:
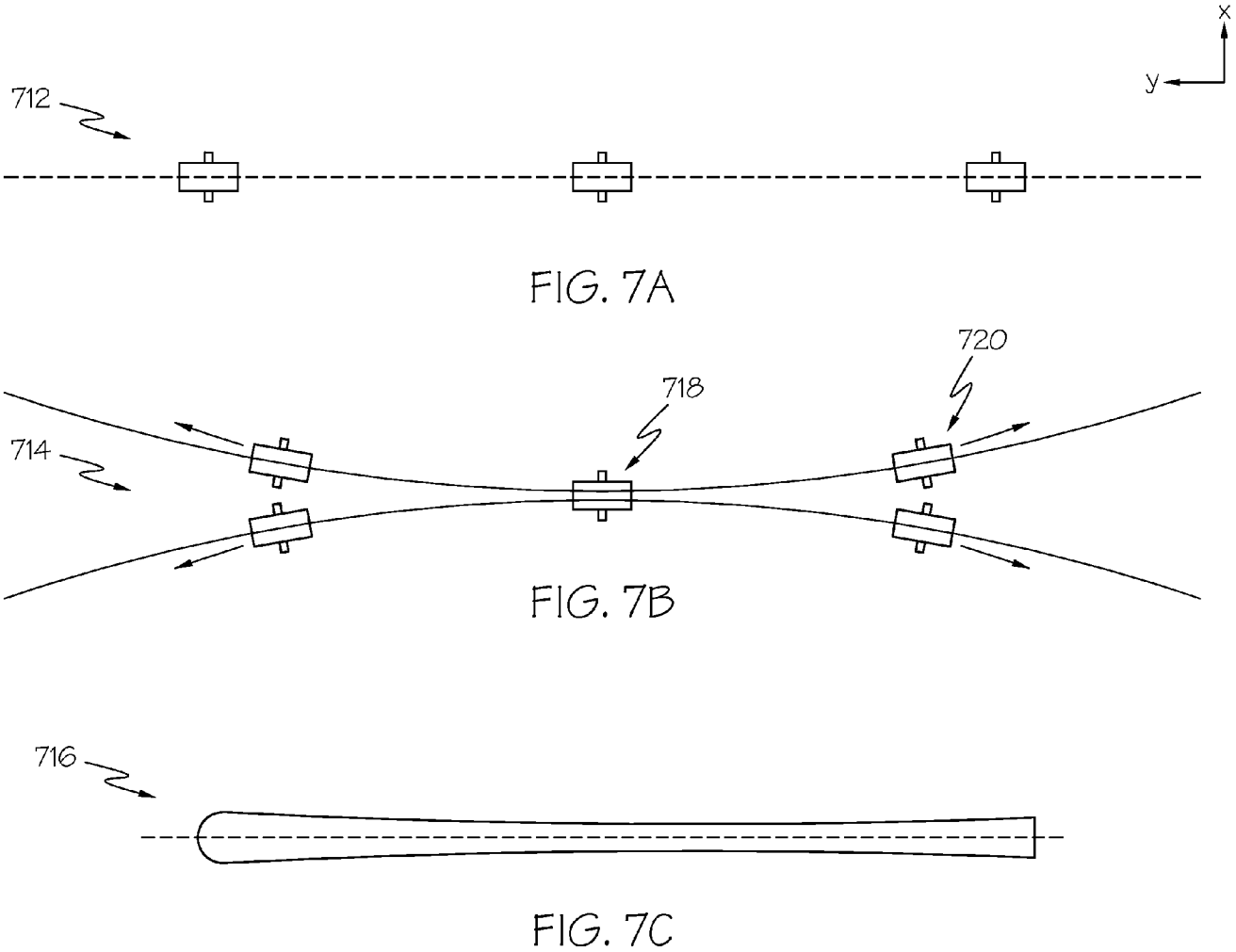
FIGS. 7A-7C depict views of (a) wheels in line, (b) wheels emulating the edge geometry of an alpine snow ski, and (c) an alpine snow ski according to an embodiment of the present invention.

Referring now to FIGS. 7A-7C, a view of wheels emulating the edge geometry of an alpine snow ski according to an embodiment of the present invention is depicted. The inventor has discovered that many people use inline skates for practicing skiing when on dry land; however, these do not provide an accurate emulation of skiing, because inline skate wheels are rigidly aligned in a straight line, as shown in wheel line model 712, synonymous with the blade of an ice skate. Therefore, an inline skate device is locked in a linear motion and is less stable than a ski as the wheel base (blade length) is short. Although a ski centerline is homologous to an inline skate wheel arrangement, the inventor has discovered that arranged and angled wheels on opposite sides of a ski-like deck, as presented in embodiments of the present invention, present a much improved emulation of the alpine skiing experience in non-alpine settings.

As discussed above with respect to FIG. 2, alpine skis travel in an arc due to the curved edge geometry of the alpine skis when an edge of the ski is engaged with the ground. Accordingly, in some embodiments of the present invention, dry-land ski device 600 (FIG. 6), emulating the edge geometry of an alpine snow ski, as shown in wheel geometry model 714, is provided. In some embodiments, dry-land ski device 600 is configured to track based on the geometry of angled and arranged wheels 604. Therefore, when wheels 604 on one side of dry-land ski device 600 are tipped up on the edge of said wheels, the wheels are said to be engaged on the ground, and dry-land ski device 600 travels in an arc.

With reference to both FIGS. 6 and 7, in some embodiments, wheels 604 are arranged to replicate the mechanics of a snow ski. As opposed to the wheels of an inline skate, wheels 604 are aligned to mimic the "side cut" geometry of a ski edge, rather than the ski centerline. Accordingly, wheels 604 only run parallel to a ski centerline (e.g., center model wheel 718 that runs parallel to ski centerline model 716) if, in some embodiments, located at the waist of deck 602, which is analogous to waist 110 of ski 102 (FIG. 1), where tangent 118 to the arc of ski edge 104 runs parallel to centerline 112. In some embodiments, wheels 604 at all other locations along deck 602 run at a slight angle relative to the centerline, parallel to tangent 118 to the arc of ski edge 104 of analogous ski 102 (FIG. 1). This is shown as angled model wheel 720, which angles away from ski centerline model 716 along an arc tangent. This angled wheel arrangement enables a side set of wheels 604 to travel in an arc when dry-land ski device 600 is tipped on its side.

By contrast, when dry-land ski device 600 is in a neutral position (i.e., all wheels 604 contact the ground simultaneously) dry-land ski device 600 tracks in a straight line (i.e., the direction of the longitudinal centerline). Device 600 travels in a straight path because the lateral pull of the wheels on opposing edges of device 600 effectively cancel each other out. This matches the behavior of an alpine ski which, as shown in ski line model 606, tracks in a straight line (i.e., the same direction as the ski centerline) when the ski lies in a neutral position flat against the ground.

Referring now to FIGS. 8A-D, illustrative examples of wheel assemblies of the dry-land ski device according to embodiments of the present invention are depicted, and more specifically, FIGS. 8A-D depict (a) an x-y plane view of a simple front, middle, and rear wheel assembly configuration of an embodiment of the present invention, (b) an x-y plane view of a full wheel assembly of one embodiment of a dry-land ski device, (c) a side view of a full wheel assembly of one embodiment of a dry-land ski device, and (d) an x-y plane view of a full, six-truck wheel assembly of one embodiment of a dry-land ski device, as mounted on an alpine ski, if using the ski as the deck of a dry-land ski device.

A first ski-like feature of embodiments of the invention is the geometry of wheel axels 810 of trucks 806 relative to longitudinal axis/centerline 812 of dry-land ski 802, which permit a dry-land ski device to mimic the flexibility and side bending of an alpine ski. Dry-land ski 802 may be a base board or deck such as an alpine ski or a structure similar to an alpine ski. Although not pictured, dry-land ski 802 may comprise a binding or boot/shoe/foot attachment site at midpoint 808 of ski 802.

The configuration geometry is best understood in reference to centerline 812 and transitional point 814. In some embodiments, one or more pairs of wheels 804 are arranged along the length of dry-land ski 802 with trucks 806 having axels 810 with specific geometry relative to centerline 812. In one embodiment, the truck/wheel placement positions are (1) at or about the tip of ski 802, (2) halfway between the tip and ski midpoint, (3) near the ski midpoint just ahead of the binding or boot/shoe/foot attachment, (4) near the ski midpoint, just behind the binding or boot/shoe/foot attachment, (5) halfway between the ski midpoint and tail, and (6) at or about the ski tail. This truck/wheel placement presents merely one embodiment of the present invention and is not intended to be limiting; it is envisioned that embodiments of dry-land ski device may comprise any plurality of wheels 804.

Figures 8A, 8B, 8C, 8D:
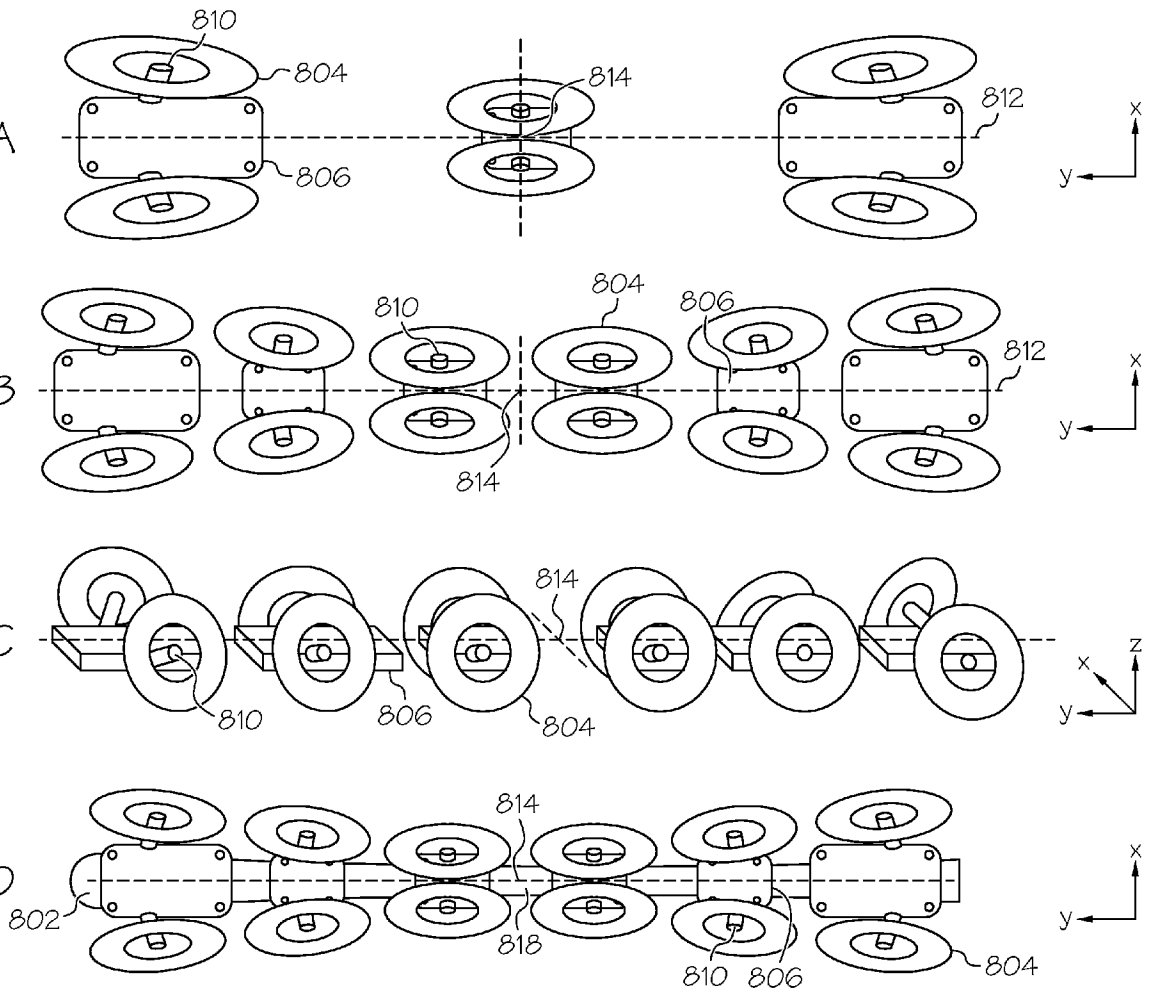
FIGS. 8A-8D depict illustrative examples of wheel assemblies of the dry-land ski device according to embodiments of the present invention.

In any case, at each position or truck 806, a wheel 804 is placed on each of two edges or axels 810. As discussed above, each wheel 804 is placed such that it sits parallel to tangent 118 of the arc of ski edge 104 of analogous ski 102 (FIG. 1), where the arc is an imaginary curve that describes circle 200 of radius "R" (FIG. 2). Therefore, as opposed to running parallel with centerline 812, wheels 804 run tangential to the arc of the ski edge being emulated. This is achieved by the geometry of axels 810 of trucks 806. Axels 810 are configured to be perpendicular to tangent 118 of the arc of ski edge 104 of analogous ski 102 (FIG. 1) for a given position along dry-land ski 802. This geometric arrangement may be further described by viewing dry-land ski 802 from above in the x-y plane, as seen in FIGS. 8A, 8B, and 8D. Some embodiments of dry-land ski 802 comprise transitional point 814, a point on centerline 812 where tangent 118 of the closest point of the arc of ski edge 104 of analogous ski 102 (FIG. 1) is parallel to the centerline. In other words, for either longitudinal side of dry-land ski device 802, an axel at transitional point 814 would be perpendicular to centerline 812, and heading outward from transitional point 814 along centerline 812, axels 810 form increasingly small acute angles with centerline 812 facing towards transitional point 814. Accordingly, transitional point 814 is the point around which axels 810 on a longitudinal side of ski device 802 rotate from pointing in a positive "y" direction to a negative "y" direction.

Figure 9A:
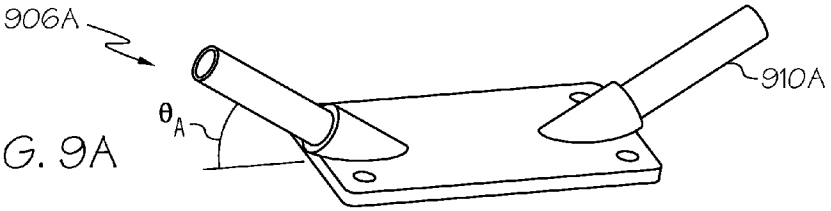
FIGS. 9A-C depict illustrative examples of truck assemblies according to embodiments of the present invention.
Figure 9B:
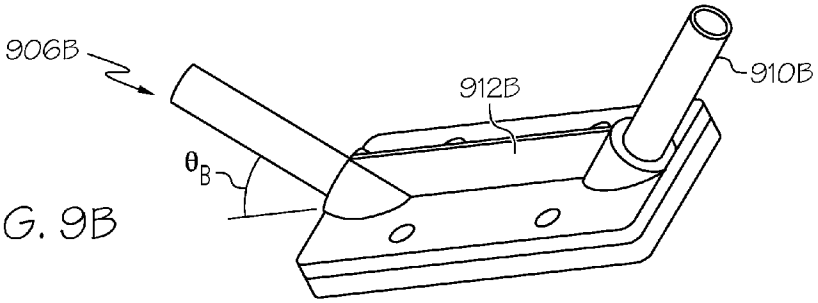
Figure 9C:
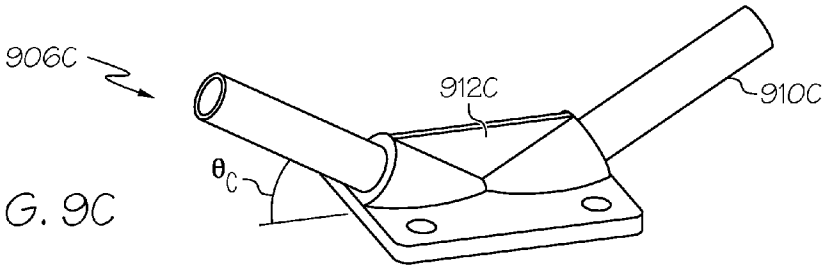

Referring now to FIGS. 9A-C, illustrative examples of trucks according to embodiments of the present invention are depicted. Relative to the horizontal (i.e., the x-y plane or a top surface of deck 602 (FIG. 6)), wheels are set with camber (i.e., an acute angle at which wheel axle 910 is set, relative to the dry-land ski base, itself set at a relative 0°). A wheel whose axle is co-planar to the ski base is described as having zero degrees (0°) of camber or no camber. In some embodiments, the camber of axel 910 relative to the horizontal ranges from about 30° to 60°. For example, axel 910A of truck 906A is set at a camber of about 30° ($\Theta_A$=30°). In another example, axel 9108 of truck 906B is set at a camber of about 60° ($\Theta_B$=60°). In still yet another example, axel 910C of truck 906C is set at a camber of about 45° ($\Theta_c$=45°). In some embodiments, camber may be varied along a length of the dry-land ski device; for example, in one embodiment, wheels may be set with a camber of about 30° near a middle of a ski deck, and set with a camber of about 45° near each end of the ski deck. In embodiments such as those employing trucks 906, wheels are "cantilevered" up and outward relative to a dry-land ski deck. In some embodiments, axels 910 may be supported, for example, by support structure 912B which extents between two separated axels, or by support structure 912C which extents between two touching axels. In some embodiments, truck 906 may be bound to a deck of a dry-land ski device using methods generally known in the art, such as rivets, nails, screws, clamps, glue, adhesive, chemical bonding, and the like.

Figure 10:
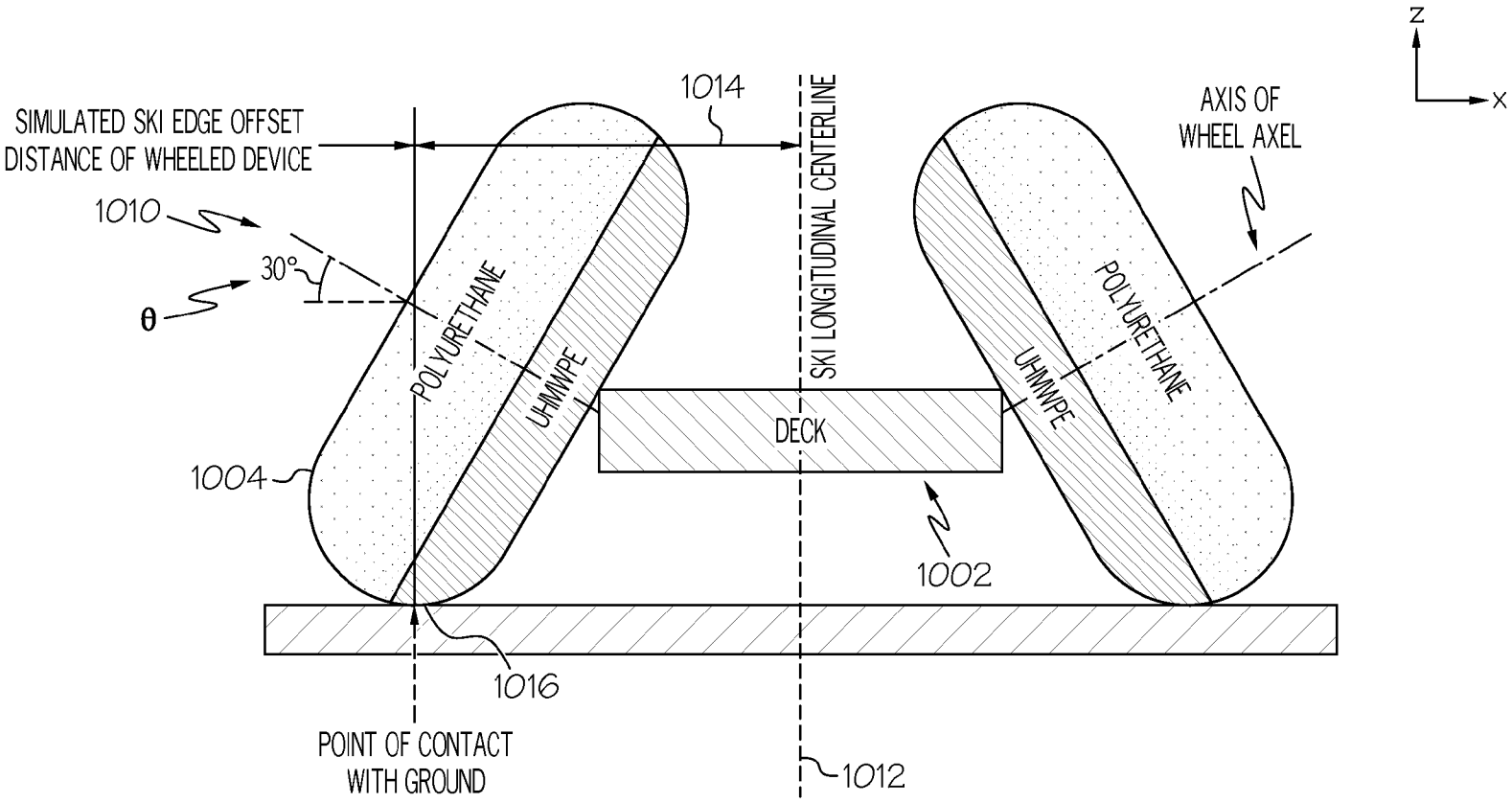
FIG. 10 depicts a cross-section of the dry-land ski device at a truck location according to an embodiment of the present invention.

Referring now to FIG. 10, a cross-section in the x-z plane of the dry-land ski device at a truck location according to illustrative embodiments is depicted. Edge offset distance (the distance from a ski centerline to a side edge) is incorporated into embodiments of the dry-land ski device via the truck geometry. As discussed above with respect to FIG. 1, as ski width varies along the body of a ski, the edge offset distance also varies, with the waist of the ski typically having a smaller edge offset distance than the shovel and tail. In some embodiments, wheel axle 1010 is set at a distance from centerline 1012 of deck 1002 (e.g., assuming an alpine ski as a deck, the narrowest offset position is at the ski waist). This may be described as the simulated edge offset distance of the dry-land ski device. The distance of axel 1010 from centerline 1012 is based on point 1016 at which wheel 1004 contacts the ground. Point of contact 1016 in turn is determined by edge offset distance of deck 1002, the amount of camber (0) built into axel 1010, and the dimensions of wheel 1004. Accordingly, in some embodiments, in order to yield a desired simulated edge offset distance 1014, any one of width of deck 1002, camber (⊖) of axels 1010, and dimensions of wheels 1004 may be modified along the length of the dry-land ski.

Figure 11A:
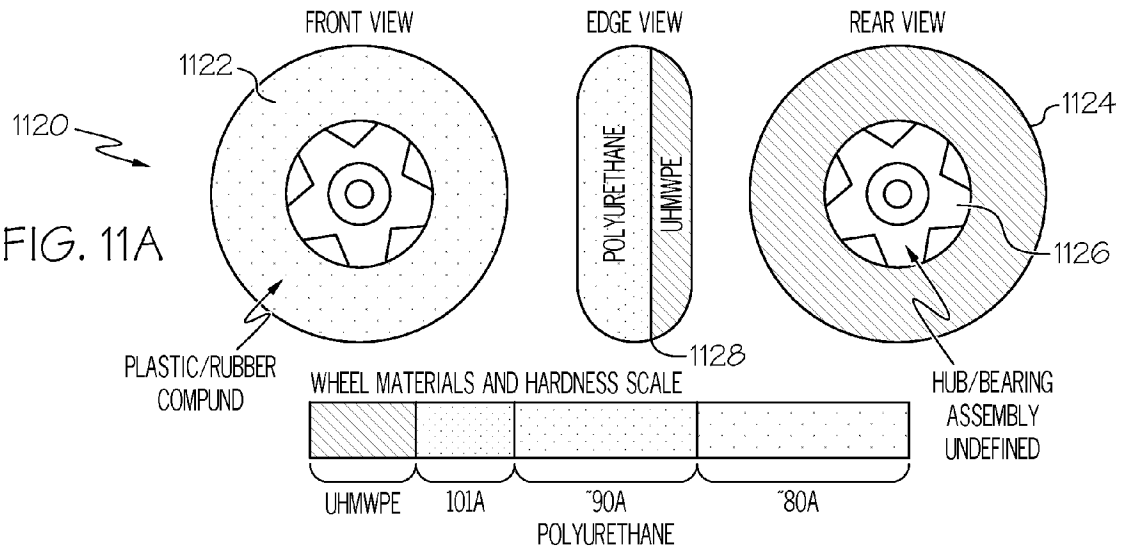
FIGS. 11A and 11B depict a wheel of the dry-land ski device according to an embodiment of the present invention.

Referring now to FIG. 11A, a wheel of the dry-land ski device according to an embodiment of the present invention is depicted. A second ski-like feature of embodiments of the invention is a wheel construction, which permits a dry-land ski device to skid, mimicking skidding of an alpine ski. As discussed above, skidding is the primary form of speed control in alpine skiing, a critical function particularly when the skiing surface slope steepness increases. Accordingly, in some embodiments, the dry-land ski device employs a wheel construction which permits a user to skid to, inter alia, control their speed.

In a typical embodiment, wheel 1120 employs a composite of materials with varied coefficients of friction that effectively emulate metal edge 324 of ski 102 (FIG. 3). Polyurethane wheels typically used for inline skates generally are composed of a homogeneous polyurethane compound and therefore, in some embodiments, do not provide an appropriate variance of the coefficient friction to allow both proper skid and edge grip. In some embodiments, construction of wheel 1120 incorporates material with an ultra-low coefficient of friction and exceptional toughness and durability, such as ultra-high molecular weight polyethylene (UHMWPE), built into a matrix of a polyurethane substrate. In some embodiments, polyurethane substrate is constructed of striated and variable-durometer (i.e., hardness) polyurethane (or a similar substance). In one such embodiment, a gradient of hardness is designed into wheel 1120, such that rear side 1124 of wheel 1120 may transition from an ultra-low coefficient of friction material (e.g., UHMWPE), to a very hard, low coefficient of friction polyurethane (such as with a durometer of 101 A), at interface 1128. Front side 1122 may then continue to progress to a successively lower durometer material (e.g., polyurethane) with corresponding progressively higher coefficients of friction. In some embodiments, the point at which wheel 1120 transitions to higher coefficient of friction materials is described as interface 1128. Wheel 1120 may be constructed around a hub or bearing 1126 of any material currently known in the art.

Figure 11B:
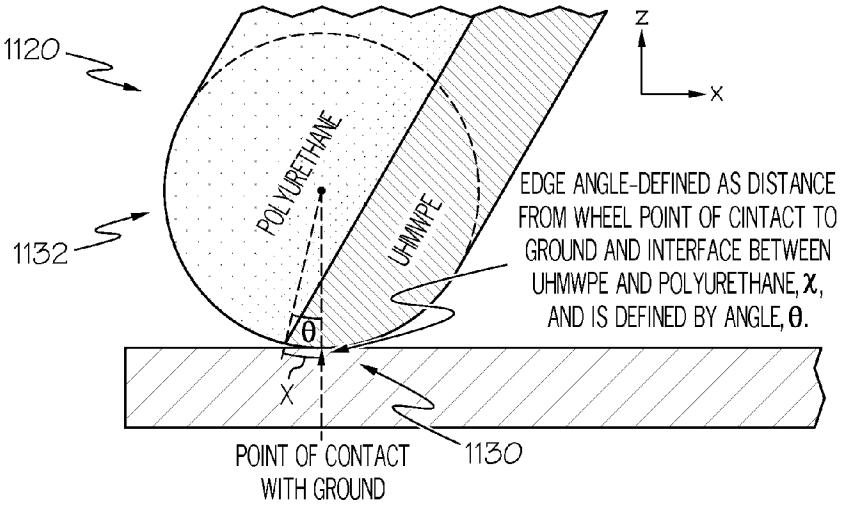

Referring now to FIGS. 11A and 11B, interface 1128 between a material with a low coefficient of friction (e.g., UHMWPE) at rear side 1124 and a material with a higher coefficient of friction (e.g., polyurethane) at front side 1122 is determined based on amount of camber "⊖" at which truck axel 910 (FIG. 9) (see also axel 1010 of FIG. 10) is set. Edge angle "⊖" is defined as the angle between point of contact with ground 1130 of wheel 1120 and interface 1128, relative to edge curvature 1132 of wheel 1120. Distance "x" between point of contact with ground 1130 and interface 1128 simulates edge base bevel of analogous alpine ski 102.

Figure 12A:
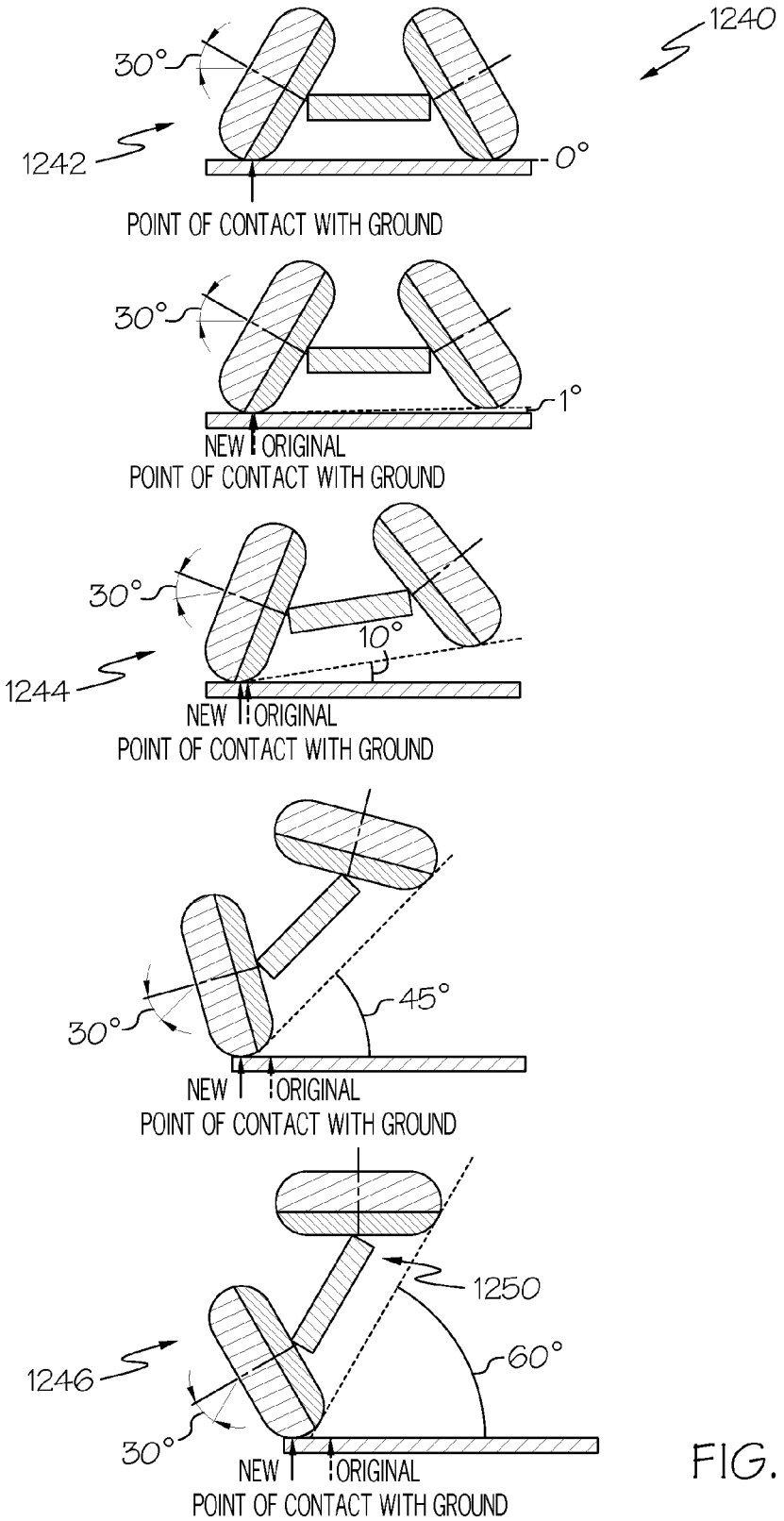
FIGS. 12A and 12B depict a simulated time-lapse series of a dry-land ski device in motion according to embodiments of the present invention.
Figure 12B:
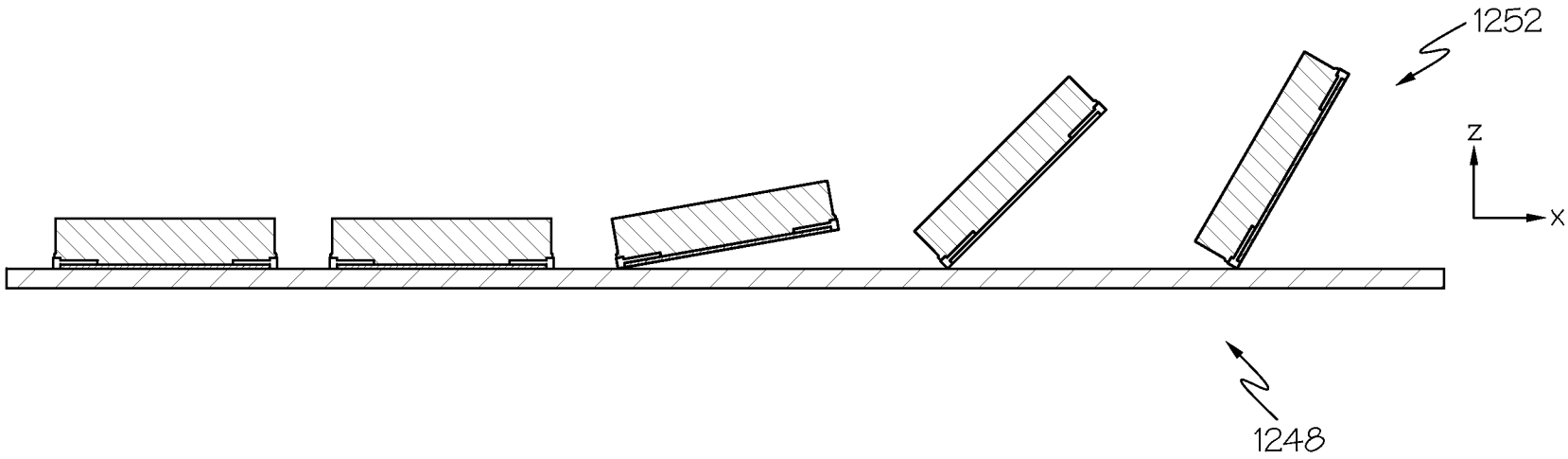

Referring now to FIGS. 12A and 12B, as well as FIG. 11, a simulated time-lapse series of a dry-land ski device in motion according to embodiments of the present invention is depicted. Harder plastic and rubber compounds typically have lower coefficients of friction than their softer counterparts. Accordingly, a harder wheel in contact with a surface will have more slip. For example, in the embodiments discussed above, when the dry-land ski device is in neutral position 1242 (i.e., flat against the ground), only rear side 1124, the portion of wheels 1120 constructed of an ultra-low coefficient of friction material, contacts the ground. In some of the embodiments described above, as a user engages an edge of the dry-land ski device by rolling the device up on edge, the ground contact point of wheel 1120 transitions (as seen at position 1244) to front side 1122, made of a softer material with a higher coefficient of friction (as seen at position 1264). At position 1246, wheel grip is considerably improved because area of wheel 1120 in contact with the ground is made of a high coefficient of friction. On the other hand, as a user releases an edge of the dry-land ski device and returns the device to a neutral position, wheel 1120 engages rear side 1124, and progressively harder materials with correspondingly lower coefficients of friction, in contact with the ground. These movements enable a user to skid the dry-land ski device.

FIG. 12A depicts a simulated time-lapse series of pictures 1240 of a cross-sectional view in the x-z plane of a truck/wheel assembly as mounted to base 1250, according to embodiments of the present invention, where the angle of the dry-land ski device is increased as it engages softer wheel portions as edge angle increases. FIG. 12B likewise depicts simulated time-lapse 1248 of a cross-section of snow ski 1252 as the ski is tipped on edge, increasing edge angle to engage the edge of the ski. As seen in time lapses 1240 and 1248, base 1250 of the dry-land ski device of embodiments of the present invention mimics the same tilting motion as ski 1252. Accordingly, the dry-land ski device of embodiments of the present invention presents a much improved emulation of the alpine skiing experience in non-alpine settings.

Further embodiments of the present invention are envisioned. In one embodiment of the invention, an alpine ski or similar base is permanently made or modified with the wheel and truck assemblies described in embodiments of the present invention. In this embodiment, wheel and truck components are permanently attached to an alpine ski and boot device, or ski-like device (e.g., a snowboard), to create a permanent dry-land skiing device. In another embodiment of the invention, an alpine ski or similar base is temporarily modified with the wheel and truck assemblies described in embodiments of the present invention. In this embodiment, wheel and truck components are temporarily attached to an alpine ski and boot device, or ski-like device (e.g., a snowboard), to create temporary dry-land skiing devices. In the embodiments described above, these modifications may be achieved using methods generally known in the art, such as rivets, nails, screws, clamps, glue, adhesive, chemical bonding, temporary adhesives, and the like.

It is apparent that there has been provided with this invention a modified alpine ski for use in non-alpine conditions such as on a dry-land inclined surface. While the foregoing description of various aspects of the invention has been presented for purposes of illustration and description, it is not intended to be exhaustive or to limit the invention to the precise form disclosed. It will be appreciated that variations and modifications will occur to those skilled in the art in light of the description. Accordingly, it is to be understood that the appended claims are intended to cover all such modifications and changes as fall within the true spirit of the invention.

What is claimed is:

1. A wheeled ski device, comprising:

a base board, the base board including an elongated structure having a top surface and a bottom surface and having a transitional point on a longitudinal axis of the elongated structure;

a plurality of opposing pairs of wheels coupled to opposite edges of the elongated structure at a plurality of points along the longitudinal axis of the elongated structure; and a truck attached to the top surface of the elongated structure and coupled to each pair of the plurality of opposing pairs of wheels, the truck having a pair of substantially straight axels, wherein the axel of each truck is set at a first angle relative to an x-y plane that is positive relative to the top surface, the plane formed by the longitudinal axis of the base board and a lateral axis of the base board; and wherein the axel of each truck is further set at a second angle relative to an y-z plane of the base board that is open towards the transitional point, the plane comprising the longitudinal axis and perpendicular to the y-z plane.

2. The wheeled ski device of claim 1, the first angle being between 30 degrees and 60 degrees.

3. The wheeled ski device of claim 1, an arm of the second angle being a perpendicular to a tangent of an edge arc of a ski simulated by the wheeled ski device, the arm being associated with the axel of each wheel.

4. The wheeled ski device of claim 1, each wheel comprising a coefficient of friction gradient from a first side of the wheel facing towards the base board to a second side of the wheel facing away from the base board, wherein the gradient comprises a interface point and wherein the interface point is based on the first angle.

5. The wheeled ski device of claim 4, the coefficient of friction gradient comprising ultra-high molecular weight polyethylene on one side of the gradient and a polyurethane substrate on another side of the gradient.

6. The wheeled ski device of claim 1, the plurality of opposing pairs of wheels, wherein a pair is coupled near each end of the elongated structure, two pairs are coupled near a midpoint of the elongated structure with a distance configured to receive a user's foot between, and at least one pair is coupled between each endpoint pair and midpoint pair.

7. The wheeled ski device of claim 6, the device configured to at least one of: turn in an arc when engaged on a side and skid when pivoted.

8. The wheeled ski device of claim 1, wherein the first angle of the pair of axels of the truck of each pair of wheels is based on a location of the truck along the elongated structure, wherein the angle decreases from an end of the elongated structure to the transition point of the elongated structure.

9. The wheeled ski device of claim 1, the elongated structure being at least one of: a ski and a snowboard, and comprising a foot attachment.

10. The wheeled ski device of claim 1, the wheels being removable.

11. The wheeled ski device of claim 1, the base board comprising a flexible material, wherein the base board flexes when one side of the opposing set of wheels are engaged on a surface.

12. A method of making a wheeled ski device, the method comprising:

affixing a plurality of opposing pairs of angled axels to opposite sides of a longitudinal axis of an elongated structure of a base board at various points along the longitudinal axis of the elongated structure, the base board having a transitional point on the longitudinal axis of the elongated structure; and affixing a wheel to each axel, wherein each axel is set at a first angle relative to an x-y plane that is positive relative to a top surface of the base board, the plane formed by the longitudinal axis of the base board and a lateral axis of the base board; and wherein the axel is further set at a second angle relative to an y-z plane of the base board that is open towards the transitional point, the plane comprising the longitudinal axis and perpendicular to the y-z plane.

13. The method of making a wheeled ski device of claim 12, the first angle being between 30 degrees and 60 degrees, and an arm of the second angle being a perpendicular to a tangent of an edge arc of a ski simulated by the wheeled ski device, the arm being associated with the axel.

14. The method of making a wheeled ski device of claim 12, each wheel comprising a coefficient of friction gradient from a first side of the wheel facing towards the base board to a second side of the wheel facing away from the base board.

15. The method of making a wheeled ski device of claim 14, wherein the coefficient of friction gradient transitions from an ultra-high molecular weight polyethylene to a polyurethane substrate on another side of the gradient.

16. The method of making a wheeled ski device of claim 12, the affixing a plurality of opposing pairs of angled axels, wherein a pair is affixed near each end of the base board, two pairs are coupled near a midpoint of the base board with a distance configured to receive a user's foot between, and at least one pair is coupled between each endpoint pair and midpoint pair.

17. The method of making a wheeled ski device of claim 12, the base board being at least one of: a ski and a snowboard, and comprising a foot attachment.

18. The method of making a wheeled ski device of claim 12, the method further comprising:

disassembling the wheeled ski device by removing the pair of axels and wheels from the base board; and using the disassembled base board component recreationally.

19. A method of using a wheeled ski device, the method comprising:

moving a wheeled ski device having a base board including an elongated structure and having a transitional point on a longitudinal axis of the elongated structure, and a plurality of opposing pairs of wheels coupled to opposite edges of the elongated structure at various points along the longitudinal axis of the elongated structure, wherein an axel of each wheel is oriented at a positive angle above a horizontal plane relative to a top surface of the base board and at an angle facing towards the transitional point relative to a vertical plane comprising the longitudinal axis and perpendicular to the horizontal axis that decreases with distance from the transitional point;

engaging a side of the wheeled ski device by turning the wheeled ski device on a side;

causing the wheeled ski device to turn in an arc in response to engaging the side;

disengaging the side of the wheeled ski device by reorienting the wheeled ski device; and causing the wheeled ski device to skid in response to disengaging the side.

20. The method of using a wheeled ski device of claim 19, the method further comprising riding the wheeled ski device down an inclined surface.

21. The method of using a wheeled ski device of claim 19, the method further comprising converting one of: an alpine ski and a snowboard, into the wheeled ski device.

* * * * *